United States Patent [19]

Kuzuya et al.

[11] Patent Number: 5,026,039

[45] Date of Patent: Jun. 25, 1991

[54] SHEET STORAGE CASE FOR USE IN IMAGE RECORDING APPARATUS

[75] Inventors: Susumu Kuzuya, Gifu; Shigeyuki Hayashi, Nagoya; Hiroaki Kimura, Nagoya; Tsutomu Suzuki, Nagoya; Katsuyoshi Sonobe, Nagoya; Takashi Nakata, Nagoya; Naoyuki Hatta, Gamagori, all of Japan

[73] Assignees: Brother Kogyo Kabushiki Kaisha, Aichi, Japan; Takayuki Hayashi, Nagoya, Japan

[21] Appl. No.: 454,405

[22] Filed: Dec. 21, 1989

[30] Foreign Application Priority Data

| | | | |
|---|---|---|---|
| Dec. 21, 1988 | [JP] | Japan | 63-165922[U] |
| Dec. 28, 1988 | [JP] | Japan | 63-332373 |
| Dec. 28, 1988 | [JP] | Japan | 63-332374 |
| Dec. 28, 1988 | [JP] | Japan | 63-332375 |
| Jan. 30, 1989 | [JP] | Japan | 1-10354[U] |
| Apr. 13, 1989 | [JP] | Japan | 1-93651 |
| Apr. 28, 1989 | [JP] | Japan | 1-50405[U] |

[51] Int. Cl.[5] ..... B65H 5/08

[52] U.S. Cl. ..... 271/11; 271/107; 271/171; 271/145; 271/265

[58] Field of Search ..... 271/11, 103, 105, 106, 271/107, 110, 145, 147, 157, 162, 164, 171, 223, 236, 238, 239, 240, 241, 248, 258, 265

[56] References Cited

U.S. PATENT DOCUMENTS

| | | | |
|---|---|---|---|
| 1,554,590 | 9/1925 | McGarvin . | |
| 1,861,605 | 6/1932 | Maas . | |
| 2,267,998 | 12/1941 | Storck . | |
| 3,883,133 | 5/1975 | Rebres . | |
| 4,030,725 | 6/1977 | Fukui et al. . | |
| 4,591,140 | 5/1986 | Illig et al. | 271/11 |
| 4,607,834 | 8/1986 | Dastin | 271/223 X |
| 4,637,598 | 1/1987 | Bouwens et al. | 271/265 X |
| 4,697,803 | 10/1987 | Kan et al. | 271/171 X |
| 4,759,537 | 7/1988 | Illig et al. | 271/11 |
| 4,780,740 | 10/1988 | Fukae | 271/171 X |
| 4,786,042 | 11/1988 | Stemmle | 271/171 X |
| 4,930,763 | 6/1990 | Harii et al. | 271/11 X |

FOREIGN PATENT DOCUMENTS

| | | | |
|---|---|---|---|
| 2245558 | 4/1975 | France . | |
| 0012541 | 1/1988 | Japan | 271/11 |
| 1152909 | 4/1985 | U.S.S.R. | 271/11 |

*Primary Examiner*—H. G. Skaggs
*Assistant Examiner*—Tuan N. Nguyen
*Attorney, Agent, or Firm*—Oliff & Berridge

[57] ABSTRACT

A sheet storage case for storing therein a stack of sheets. The sheet storage case is assembled into a sheet feeding device which feeds out an uppermost sheet of the stack of sheets. The sheet storage case includes a bottom plate, a first positioning member fixedly secured to the bottom plate and a slidably movable second positioning member provided in the bottom plate. The second positioning member has a sheet receiving portion for receiving the stack of sheets. The second positioning member is movable toward and away from the first positioning member. To mount a stack of sheet on the sheet storage case, the second positioning member is moved away from the first positioning member, the sheets are placed on the sheet receiving portion, and then the second positioning member is moved toward the first positioning member. The side edges of the sheets are aligned, because the sheets are fittedly interposed between the two positioning members. The uppermost sheet is taken out by a mechanism which includes a suction cut which is brought to contact with the uppermost sheet to attract the latter. The suction cup to which the sheet is attracted is swung in the position above the sheet storage case to separate the uppermost sheet from the reminder.

12 Claims, 10 Drawing Sheets

SHEET STORAGE CASE FOR USE IN IMAGE RECORDING APPARATUS

BACKGROUND OF THE INVENTION

The present invention relates generally to a sheet storage case for storing therein a stack of sheets. More particularly, the invention relates to a sheet storage case adapted to be assembled into a sheet feeding device which feeds out an uppermost sheet of the stack of sheets.

Various types of sheet storage cases or sheet cassette cases have been known in the art. One of the conventional sheet storage cases includes a plate-like member provided within a cassette case which regulates a stacking position of the sheets. The position where such a plate-like member is provided agrees with the size of the sheet to be received. With this structure, no gap is provided between the sheets and the sheet position regulating member. Consequently, it would be rather difficult to dispose a stack of sheets into the cassette case, particularly, to align the edges of the stack of sheets with one another.

In another conventional sheet cassette case, a snubber is provided therein which is assembled in a sheet feed means provided in a copying machine, which sheet feed means takes out each sheet. In such sheet cassette case, an uppermost sheet of the stack of sheets is taken out by the action of the sheet feed means of the copying machine. In this case, one edge of the sheet is temporarily engaged with the snubber so that the sheet is bent. Accordingly, subsequent sheet is separated from the uppermost sheet because of it inherent rigidity. However, a sheet portion engaging the snubber may be subjected to scratching or damage. Particularly, in case of a particular type of the sheet such as the developer sheet, developer materials coated on the surface thereof may be scraped off due to the frictional engagement with the snubber. Therefore, a desirable image formation on the sheet may not be attainable.

A sheet cassette for use in a copying machine is one of the typical examples of the sheet storage case. In such a sheet cassette, a guide plate is fixed in a sheet case by screws, etc. for regulating a position of the sheets. However, it would be rather troublesome in storing the sheets therein, and if a plurality of sheets are irregularly stored in the cassette, the sheets may be deformed or folded.

An image recording apparatus which employs a photosensitive pressure-sensitive recording medium has been known in which special attention should be made with respect to a moisture absorption into the recording medium. In the conventional apparatus, the photosensitive pressure-sensitive recording medium exposed to light in accordance with an imaging information is superposed with a developer sheet (developer material coated sheet) and are uniformly pressed together. In this case, if irregular pressure distribution is provided with respect to the every pressing positions, wrinkles may be generated in the developer sheet or the photosensitive pressure sensitive sheet. The wrinkles are considered to be produced by non-uniformity in density of a base sheet which constitutes the developer sheet, which nonuniformity may be caused by moisture absorption from cutting edges of the developer sheets.

The developer sheets undergo excessive moisture absorption thereinto through an upper surface area of the uppermost sheet and through cutting edges of the sheet stack. For example, when leaving the developer sheet at an atmosphere having a temperature of 28° C., and humidity of 90% for about 30 minutes, a large amount of moisture is absorbed into the sheet. If image recording operation is carried out with employing such developer sheet having large water content, the uppermost sheet does not provide significant problem, since water is uniformly absorbed in an entire area thereof. However, with respect to the subsequent sheets, since water is absorbed into the sheet through the cutting edges, the edge portions of the sheet provide high moisture content ratio, whereas a central portion of the identical sheet still has its dried state. As a result, irregularities in density is provided in the sheet, to thereby promote generation of the sheet wrinkles.

However, no special attention has been drawn to the conventional developer sheet cassette in respect of the moisture absorption. Therefore, an operator must store only a required amount of sheets into the cassette for the copying, and such sheet number counting works may be troublesome for the operator.

In still another conventional sheet storage container, a bottom plate is provided for mounting thereon cut sheets etc. The bottom plate merely serve to mount thereon the sheets. However, in case of exchanging the sheets with another kind of the sheets, a finger must be inserted into a narrow space within the container body for taking out the sheets, which has been troublesome.

In a conventional image recording apparatus of the type having a sheet feeding device, there are provided two sensors, one being adapted for detecting a sheet feed cassette assembled into a main body of the apparatus and the other being adapted for detecting sheets within the cassette. However, employment of the two sensors is disadvantageous in terms of cost and an operational reliability. Further, installations of the mechanical components and assembling works may be troublesome. Furthermore, it would be difficult to perform detection of the sheets within the cassette by a simple arrangement.

SUMMARY OF THE INVENTION

The present invention has been made to solve the above-described drawbacks, and it is an object of the invention to provide a sheet storage case capable of facilitating the sheet stack installation into a cassette case, and particularly capable of facilitating alignment of edges of the stacking sheets.

Another object of the invention is to provide a sheet storage case capable of feeding out the uppermost sheet of the sheets stacked in the case while avoiding any damage to the surface of the sheet.

Still another object of the invention is to provide a sheet storage case which facilitates sheets accommodations within the case.

Further object of the invention is to avoid moisture entry into the sheet through the sheet cutting edges, to thereby avoid generation of the wrinkles in the sheets.

Still further object of the invention is to provide a sheet feeding device capable of taking out each one of the sheets with avoiding any damage to the surface of the sheet.

Yet further object of the invention is to provide a sheet storage container having a movable member at a bottom portion of the container body, so that the sheet can be easily taken out for the purpose of the sheet exchange by lifting up the movable member.

Yet further object of the present invention is to provide means for detecting existence of a sheet feed cassette and a sheet stored therein in an image recording apparatus with using a single sensor.

In order to achieve the above and other object, there is provided a sheet storage case for storing therein a stack of sheets, the sheet storage case being adapted to be assembled into a sheet feeding device which feeds out an uppermost sheet of the stack of sheets, the stack of sheets having first, second, third and fourth edges, the sheet storage case comprising a bottom plate being configured to substantially in rectangular shape and having first, second, third and fourth edges, the firsts and second edges extending in a direction in which the uppermost sheet of the stack of sheets is fed out by the sheet feeding device, a first positioning member fixedly secured to the bottom plate for positioning the first edges of the stack of sheets, the member having a sheet positioning face oriented in a first direction substantially in parallel to the first edge of the bottom plate and substantially orthogonal to the bottom plate, and a second positioning member provided in the bottom plate to be slidably movable in a second direction perpendicular to the first direction for positioning the second edges of the stack of sheets, the second positioning member having a sheet receiving portion for receiving the stack of sheets and a sheet positioning face for positioning the second edges of the stack of sheets.

The sheet storage case further comprises a third positioning member fixedly secured to the bottom plate for positioning the third edges of the stack of sheets, and a fourth positioning member provided in the bottom plate to be slidably movable in the first direction. The second and fourth positioning members are movable in interlocking relation with each other. At least one of the first, second, third and fourth positioning members has a sheet contacting portion formed with a frictional material, such as nylon. The first, second and fourth positioning members are provided with sheets formed of closed cell type foamed polyethylene, and the third positioning member is provided with a sheet formed of polyethylene terephthalate and a meshed sheet formed of nylon over the polyethylene terephthalate sheet.

The sheet feeding device comprises a mechanism for suspending the uppermost sheet of the stack of sheets in a third direction substantially perpendicular to the bottom plate. The comprises an arm extending in the third direction and having first and second ends, means coupled to the first end of the arm for moving the arm toward and away from the uppermost sheet and for swinging the arm in a position above the uppermost sheet, and a suction member coupled to the second end of the arm, the suction member being brought to contact with the uppermost sheet to attract the latter, the suction member to which the uppermost sheet is attracted being swung in the position above the uppermost sheet to separate the uppermost sheet from the reminder.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

Sheet storage cases according to the present invention are particularly advantageous when assembled into an image recording apparatus of the type described below.

Figure 14:
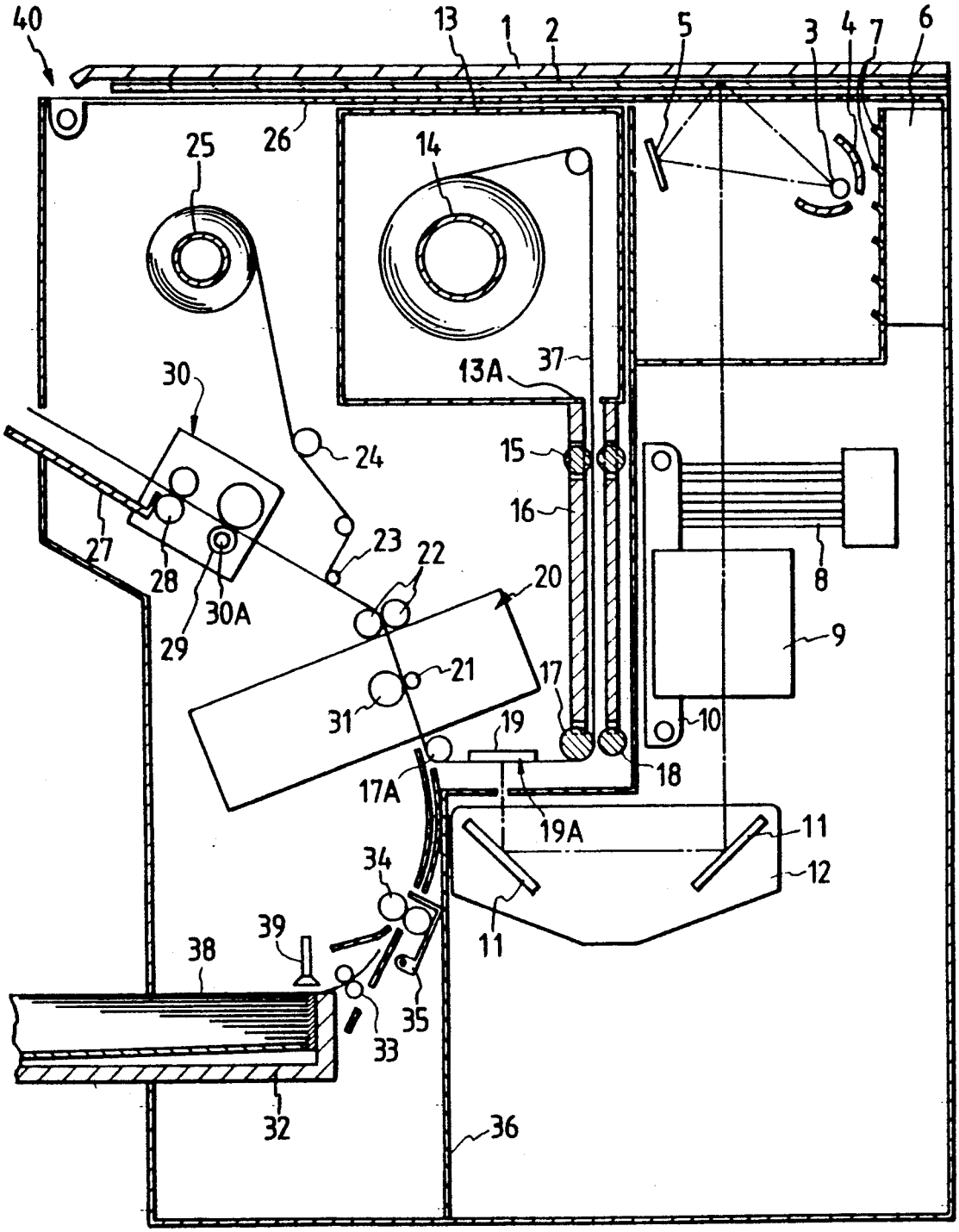
FIG. 14 is a vertical cross-sectional view showing a color image recording apparatus to which the sheet storage cases according to the present invention are best applied.

FIG. 14 shows an image recording apparatus capable of performing a full-color recording or copying. In this apparatus, a transfer type image recording medium as disclosed in U.S. Pat. No. 4,399,209 to Sanders et al is used. Briefly, this recording medium (hereinafter referred to as "microcapsule sheer") is coated with an immense number of microcapsules on one surface thereof. The microcapsule encapsulates photo-curing (or photo-softening) resin and a chromogenic material of one of three primary colors, i.e. cyan, magenta and yellow. There is a separate image receiving sheet (hereinafter referred to as "developer sheet") having a surface coated with a developer material. When the microcapsule sheet is selectively exposed to light, the mechanical strength of the microcapsules in the exposed area is changed from soft to hard or vice versa to thereby form a latent image thereon corresponding to the pattern of the exposure. The latent image on the microcapsule sheet is developed under pressure to provide a visible image on the developer sheet by rupturing the microcapsules of weaker mechanical strength and having the chromogenic material released therefrom react with the developer material.

Referring to FIG. 14, a light shielding partition plate 36 is disposed in the apparatus 40 to spacedly divide the apparatus into two chambers. That is, a light source unit and an optical system are disposed within one chamber whereas other requisite units, such as a pressure developing and thermal fixing units, are disposed within the other chamber.

An elongated web-like microcapsule sheet 37 wound around a cartridge shaft 14 is retained in a microcapsule sheet cartridge 13 that is detachably disposed at a position immediately below an original support pane 2 and is formed with a bottom opening 13A. An exposure unit 19 is disposed below the sheet cartridge 13 at a downstream side thereof. The sheet 37 passes through a number of rollers and a pressure developing unit 20, and a leading end of the sheet 37 is attached to a take-up shaft 25 positioned beside the sheet cartridge 13. Between the sheet cartridge 13 and the exposure unit 19, feed roller 15 and a barrel roller 17 are rotatably provided at a vertical sheet path for guide travel of the sheet toward the exposure unit 19. At the downstream of the exposure unit 19, there is provided the pressure developing unit 20 which includes a small-diameter roller 21 and a backup roller 31.

At a lower portion of the apparatus 40, there is provided a developer sheet cassette 32 for storing therein a stack of developer sheets 38. Immediately above the cassette 32, a feedout member 39 is provided to feed the uppermost developer sheet 38 toward the pressure developing unit 20. The feedout member 39 has a suction cup at its lower end. Between the cassette 32 and the pressure developing unit 20, two pairs of feed rollers 33, 34 and a registration gate 35 are provided so as to feed the developer sheet 38 and align the leading edge thereof.

At downstream of the pressure developing unit 20, another pair of feed rollers 22 are provided so as to transport the sheet at a constant speed. This speed is coincident with a horizontally moving speed of the original support pane 2. At downstream of the feed rollers 22, a separation roller 23 is provided at which the microcapsule sheet 37 is separated from the developer sheet 38. The separated microcapsule sheet 37 is taken-up by the take-up shaft 25 through a meander travel control roller 24. On the other hand, a thermal fixing unit 30 is provided at the downstream of the separation roller 23. The thermal fixing unit 30 includes a hollow heat roller 29, in the interior of which a heater element 30A is disposed. Further, a pair of feed rollers 28 are provided to feed the image fixed developer sheet 38 toward a discharge tray 27.

Next, an optical system and optical path in the apparatus 40 will be described. As shown, the apparatus 40 has its top plate portion provided with a cover member 1 and the original support pane 2. The original support pane 2 is formed of a light transmissive material and is movable in the horizontal direction and on which an original document (not shown) is placed face down. At the upper right side of the apparatus 40, fixedly provided is a halogen lamp 3 extending in the direction perpendicular to the sheet of drawing, and a semi-cylindrically shaped reflector 4 is disposed to surround the lamp 3. The halogen lamp 3 emits a light toward the original support pane 2.

Therefore, the light emitted from the halogen lamp 3 can be sequentially irradiated onto the entire surface over the region from one to the other end of the original support pane 2 as the original support pane 2 moves horizontally. The light from halogen lamp 3 passes through the transparent original support pane 2 and is reflected from the original placed thereon. The cover member 1 is provided to prevent this light from leaking out of the apparatus. To irradiate the light from the halogen lamp 3 onto the original at a high efficiency, a flat reflector 5 is disposed to face the halogen lamp 3 and receive the light from the lamp 3 and directs it toward the original document. At the rear side of the halogen lamp 3, there are provided a fan 6 and a louver 7 for introducing an external air into the apparatus, with which air is effectively impinged upon the lamp 3 to cool the same.

A filter unit 8 having a plurality of filter elements is disposed below the original support pane 2. A lens unit 9 is provided below the filter unit 8. Light emitted from the halogen lamp 3 and reflected from the original document passes through the filter elements 8 and enters the lens 9. The filter elements 8 alter the light transmissive characteristic in accordance with the sensitivity characteristics of the microcapsule sheet 37, to thereby adjust the color tone of a copied output image. The lens 9 is fixedly secured to a lens mounting plate 10, and fine angular adjustment of this lens with respect to a light path is achievable.

A pair of reflection mirrors 11 are provided below the lens 9. The focused light which has passed through the lens 9 changes its direction by 180 degrees (completely reverse direction) by the two reflection mirrors 11, and the thus oriented light is applied to the microcapsule sheet 37 closely contacting the bottom of an exposure table 19A to form the latent image thereon. The two reflection mirrors 11 are securely mounted to a mirror mounting plate 12. The mirror mounting plate 12 is vertically movably provided so that the adjustment of the distance of the light path and focusing adjustment can be effected by fine adjustment of the position of the mirror mounting plate 12. The original, the filter 8, the lens 9, the pair of reflection mirrors 11 and the exposure table 19A define a U-shape or J-shape light path in combination. That is, the optical path is bent into U-shape or J-shape, which path comprises a first vertical path directed downwardly, a second path directed horizontally and a third path directed upwardly. At the first optical path, the light reflected from the original is oriented downwardly, and at the third path the light is directed toward the imaging surface of the microcapsule sheet 37 at the exposure zone 19A, and the reflection mirror unit (11, 12) is disposed at the second optical path extending in horizontal direction. When the mirror mounting plate 12 is downwardly moved by a certain distance, the total light path distance is increased by a distance twice as long as the moving distance of the plate 12, yet maintaining the focusing position on the exposure zone 19A unchanged.

The mirror mounting plate 12 can maintain relative angular positional relationship between the pair of mirrors 11 regardless of the vertical movement of the plate 12. Accordingly, the plate 12 fixedly mounting the two mirrors can be simply assembled to the recording apparatus 40 as those can be treated as a single integral unit. It should be noted that only the pair of reflection mirrors 11 are required to obtain a normal upstanding or erect imaging direction at the exposure zone 19A, since the light is finally applied to the exposure zone upwardly, i.e, the microcapsule sheet 37 is exposed to light at the exposure zone 19A with the microcapsule coated surface facing down.

Operation of the apparatus 40 arranged as above will be described.

The microcapsule sheet 37 drawn out from the opening 13A of the cartridge 13 is fed by the feed rollers 15 and guided by the barrel rollers 17,18. The sheet 37 then passes while contacting the lower face of the exposure table 19A where imaging light is applied to the sheet 37, so that a latent image is formed on the sheet 37.

More specifically, the cover member 1 is lifted up for placing the original document on the original support pane 2. Then, when a start button (not shown) is depressed, the original support pane 2 is moved to one direction (rightwardly in FIG. 14), so that one side edge of the pane 2 (left side edge in FIG. 14) stops at a first position where the one side edge of the pane 2 is coming into confrontation with the light source. Thereafter, with the halogen lamp 3 being lit, the original support pane 2 is then moved in a second direction (leftwardly in FIG. 14) opposite to the first direction. The light emitted from the halogen lamp 3 is reflected from the original, and the light reflected therefrom passes through the filter 8 and lens 9 and is reflected at the two reflection mirrors 11. The last reflected light is finally directed toward the microcapsule sheet 37 which is located under the exposure table 19A, thereby forming a latent image on the sheet 37. At this time, since the microcapsule sheet 37 is moved under the exposure table 19A in the second direction (leftwardly in FIG. 14) at the same speed as the moving speed of the original support pane 2, the latent image corresponding to the original image is formed on the microcapsule sheet 37 at an equi-magnitude. Since the conveying speed of the microcapsule sheet 37 is controlled to be constant by feed rollers 22 and is set equal to the moving speed of the original support pane 2, line latent images having given widths are sequentially formed on the microcapsule sheet 37 that is passing along the lower surface of the exposure table 19A.

The sheet 37 is then fed to the pressure developing unit 20 by the guide roller 17. At the pressure developing unit 20, the sheet 37 and the developer sheet 38 are held in facial contact with each other and are applied with pressure to develop the latent image and form a visible image on the developer sheet 38. The microcapsule sheet 37 leaving from the cartridge 13 is kept unexposed to light due to the presence of a shielding cover 16. The developer sheets 38 are fed out one by one by the feedout member 39, and each sheet 38 is fed to a sheet inlet of the pressure developing unit 20 after the leading edge of the sheet 38 is aligned by the feed rollers 34 and the registration gate 35.

The microcapsule coated surface of the sheet 37 on which a latent image is formed contacts the developer coated surface of the developer sheet 38 inside the pressure developing unit 20, and these superposed sheets are pressed together by the small-diameter roller 21 and the backup roller 31. Unexposed microcapsules are ruptured by the pressure applied, to thereby form an output image on the developer sheet 38 due to the reaction of the chromogenic material released from the ruptured microcapsules with the developer material.

In summary, in timed relation with the movement of the original support pane 2 in the second direction, the feedout roller 39 feeds out the developer sheets 38 one by one from the developer sheet cassette 32. The developer sheet 38 is brought to facial contact with the exposed microcapsule sheet 37 and the both sheets are fed to the pressure developing unit 20 in which the latent image on the microcapsule sheet 37 is developed and transferred onto the developer sheet 38.

The microcapsule sheet 37 and developer sheet 38 leaving from the pressure developing unit 20 are fed out by the feed rollers 22 and are separated by the separation roller 23, the former sheet 37 directing upward and the latter sheet 38 directing in the straight direction. Thereafter, the developer sheet 38 is subjected to thermal fixing in the thermal fixing unit 30 and is then discharged onto the discharge tray 27 face up. The microcapsule sheet 37 leaving from the pressure developing unit 20 and passing through the separation roller 23 and the meandering control roller 24 is wound around the take-up shaft 25. When the movement of the original support pane 2 is stopped at a second position where another edge (right side in FIG. 14) of the pane 2 confronts the light source, the scanning of the original document is completed and the halogen lamp 3 is turned off.

Figure 1:
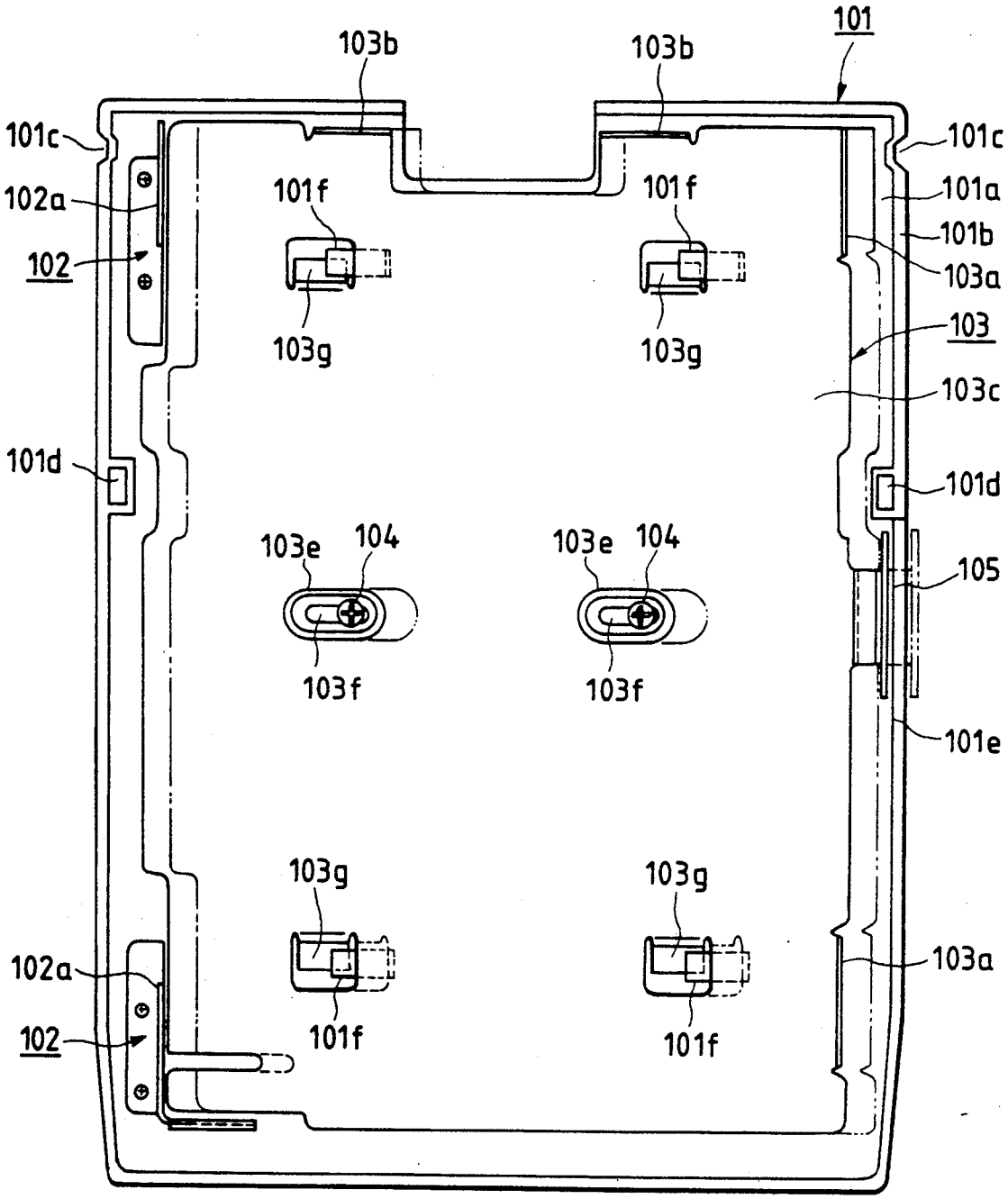
FIG. 1 is a plan view showing a sheet storage case according to one embodiment of the present invention.
Figure 2:
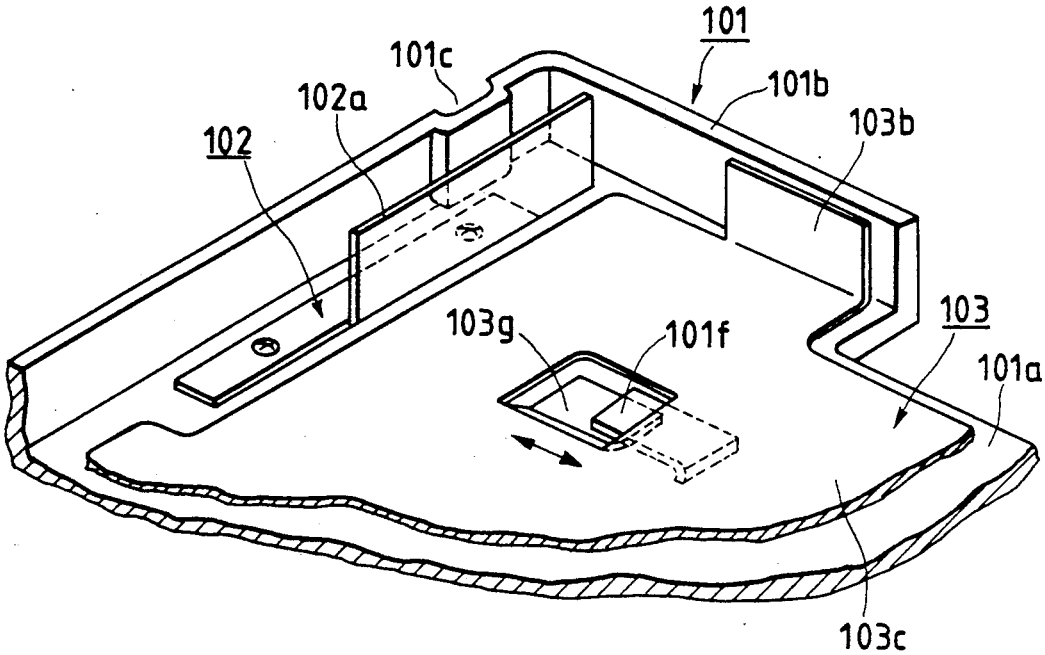
FIG. 2 is a perspective view showing a part of the sheet storage case shown in FIG. 1.

A sheet storage case according to a first embodiment of this invention will now be described with reference to FIGS. 1 through 3. In FIGS. 1 and 2, a sheet storage case 101 includes a bottom plate **101*a* and a side wall 101*b* disposed to surround an outermost edge of the bottom plate 101*a*. The side wall 101*b* is formed with a recessed portion 101*c* which serves as a positioning member when assembling the cassette case 101 into a sheet feed device (not shown) or into the image recording apparatus shown in FIG. 14. The side wall 101*b* is also formed with a hollow upstanding portions 101*d* for reinforcing purpose and a low wall portion 101*e***.

A stationary plate 102 is fixed to one side portion of the bottom plate **101*a* for positioning a stack of sheets. Further, a movable plate 103 is slidably disposed within the case 101, the movable plate 103 being movable toward and away from the stationary plate 102 as shown by a solid line and two-dotted chain line in FIG. 1**.

The stationary plate 102 has an upstanding piece **102*a*, and the movable plate 103 has an upstanding portion 103*a*. The upstanding piece 102*a* and the upstanding portion 103*a* confront with each other in a sliding direction of the movable plate 103, i.e., at left and right sides in FIG. 1. Further, the movable plate 103 has a sheet receiving portion 103*c* whose generally central portion is provided with downwardly bending portions 103*e* in which slots 103*f* are formed. Further, the bottom plate 101*a* is provided with pins 104 extending upwardly through the slots for guiding sliding movement of the movable plate 103 relative to the bottom plate 101*a*. Furthermore, at four corner portions of the movable plate 103, engaging pawls 103*g* are provided. These engaging pawls 103*g* are provided by slitting the corresponding portions of the movable plate 103 with three sides, and forcibly bending the slitted portion downwardly. Engagement pieces 101*f* are provided on the bottom plate 101*a*. Each of the engaging pawls 101*f* is slidingly engageable with each of the downwardly bending pawls 103*g***.

Further, an upstanding wall is provided at the movable plate 103 at a position in confrontation with the low height wall **101*e* of the side wall 101*b*. Abutting member 105 is attached to the upstanding wall for providing a sliding motion of the movable plate 103. Furthermore, at an upper edge portion of the movable plate 103 in FIG. 1, an upstanding portions 103*b*** are provided for positioning the upper edge position of the sheets.

Figure 3A:
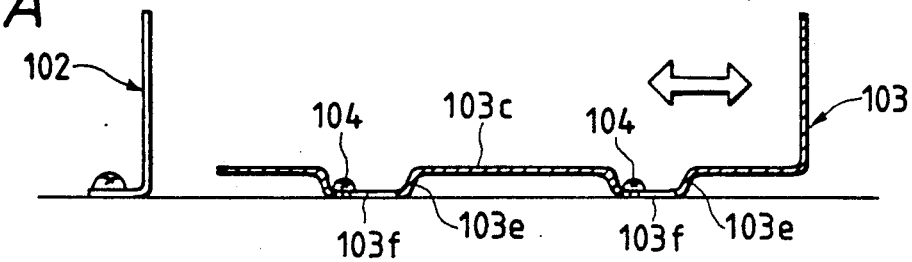
FIGS. 3A through 3B are vertical cross-sectional views showing the sheet storage case shown in FIG. 1 for description of aligning side edges of a stack of sheets positioned in the sheet storage case.
Figure 3B:
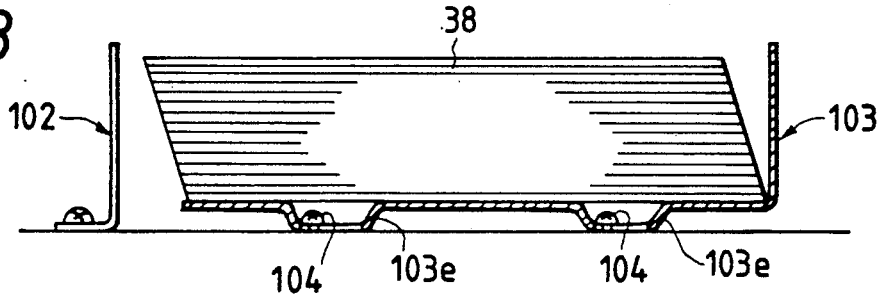

Next, sheet setting modes will be described with reference to FIGS. 3A, 3B and 3C. First, as shown in FIG. 3A, the movable plate 103 is moved to a direction away from the stationary plate 102, and as shown in FIG. 3B, a stack of sheets 38 are placed on the bottom surface 103*c* of the movable plate 103 and at a position between the plates 102 and 103 of the case 101.

In this case, a distance between the upstanding portions of the plates 102 and 103 is greater than a width of the sheet 38, and therefore, the sheet 38 can be easily placed on the case 101. Further, in this instance, it is unnecessary to align the edges of the sheets with one another.

Figure 3C:
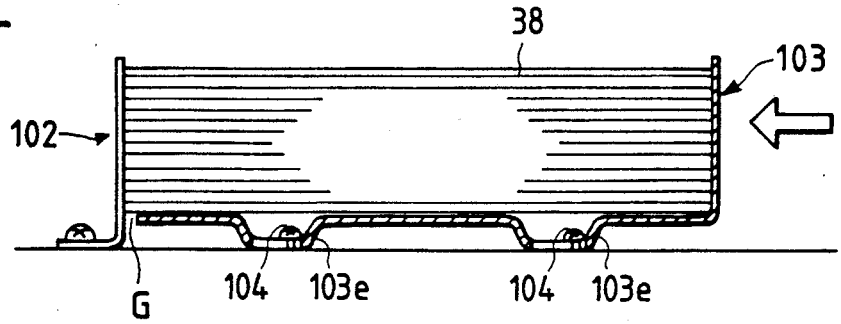

As shown in FIG. 3C, the movable plate 103 is moved in a direction indicated by an arrow, so that the both side edges of the sheets 38 are closely interposed between the upstanding portions of the plates 102 and 103. Consequently, each of the side edges of the sheets 38 is aligned with one another. As shown in FIGS. 3B and 3C, the sheets 38 stacked with their side edges being displaced from one another are aligned in accordance with the sliding movement of the plate 103 toward the plate 102. During this aligning action, neighboring sheets are mutually slid with each other, to thereby promote separation of one sheet from another.

Incidentally, these plates 102 and 103 are designed in such a manner that even at the final state shown in FIG. 3C, a gap G is provided between the plates 102 and 103, that is, between the upstanding portion of the stationary plate 102 and a leading edge face of the bottom portion 103*c* of the movable plate 103.

A guide may be provided in the sheet feeding device (not shown). The guide provides wall members, and distance between the wall members is gradually decreased in a sheet cassette inserting direction into the sheet feeding device. With this structure, when inserting the sheet feed cassette into the device, the abutting member 105 (see FIG. 1) of the cassette is brought into sliding engagement with the guide, so that the movable plate 103 is slidingly moved to thereby automatically align the sheet edges with one another simultaneous with the cassette inserting operation.

According to the first embodiment of the present invention, since the movable plate is provided which is movable toward and away from the stationary plate which serves as a sheet positioning member, sheets can be easily accommodated into the sheet storage case with the large open space defined between the movable and the stationary plates. Further, the sheet edges can be aligned with one another by simply slidingly moving the movable plate toward the stationary plate. It would be apparent from the foregoing description that the sheet storage case of this embodiment can be used not only in the image recording apparatus shown in FIG. 14 but also in a monochromatic copying machine, printer or the like.

A sheet storage case according to a second embodiment of the present invention will be described with reference to FIGS. 4 through 7. The sheet storage case of this embodiment is particularly useful when employed in the image recording apparatus shown in FIG. 14 for storing therein a stack of developer sheets.

Figure 4A:
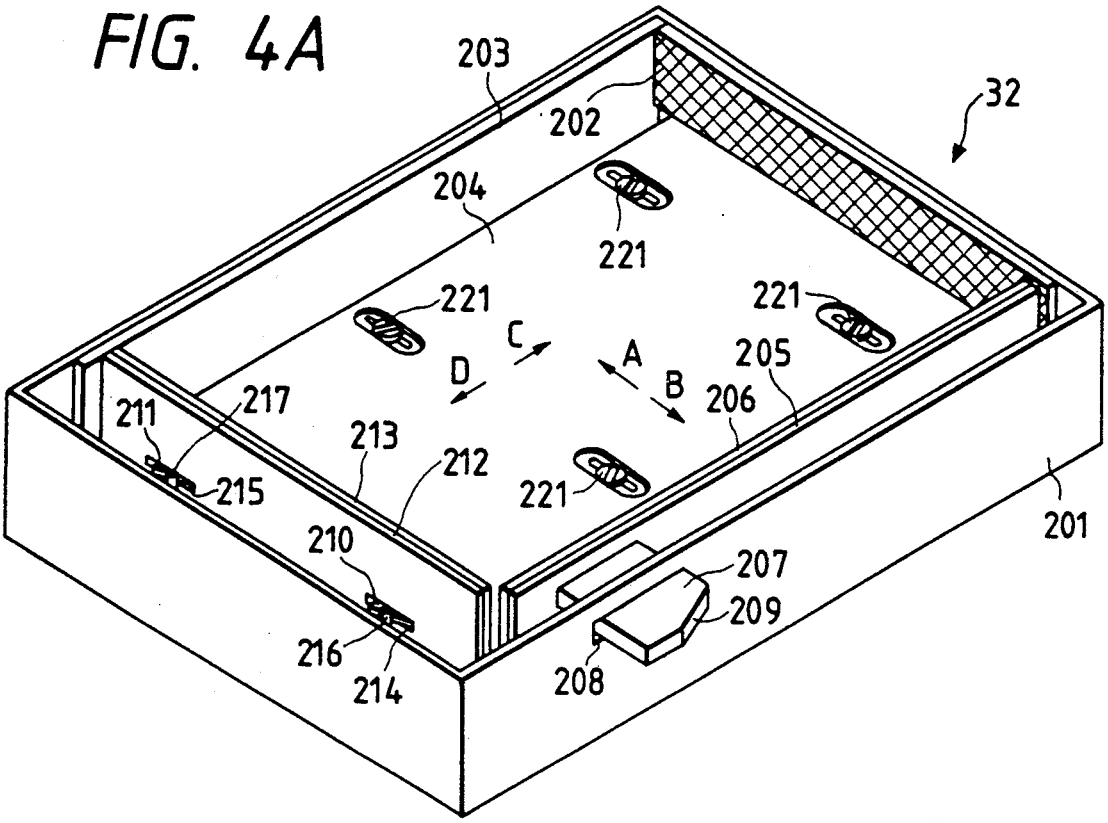
FIGS. 4A and 4B are perspective views showing sheet storage cases according to another embodiment of the present invention.
Figure 5:
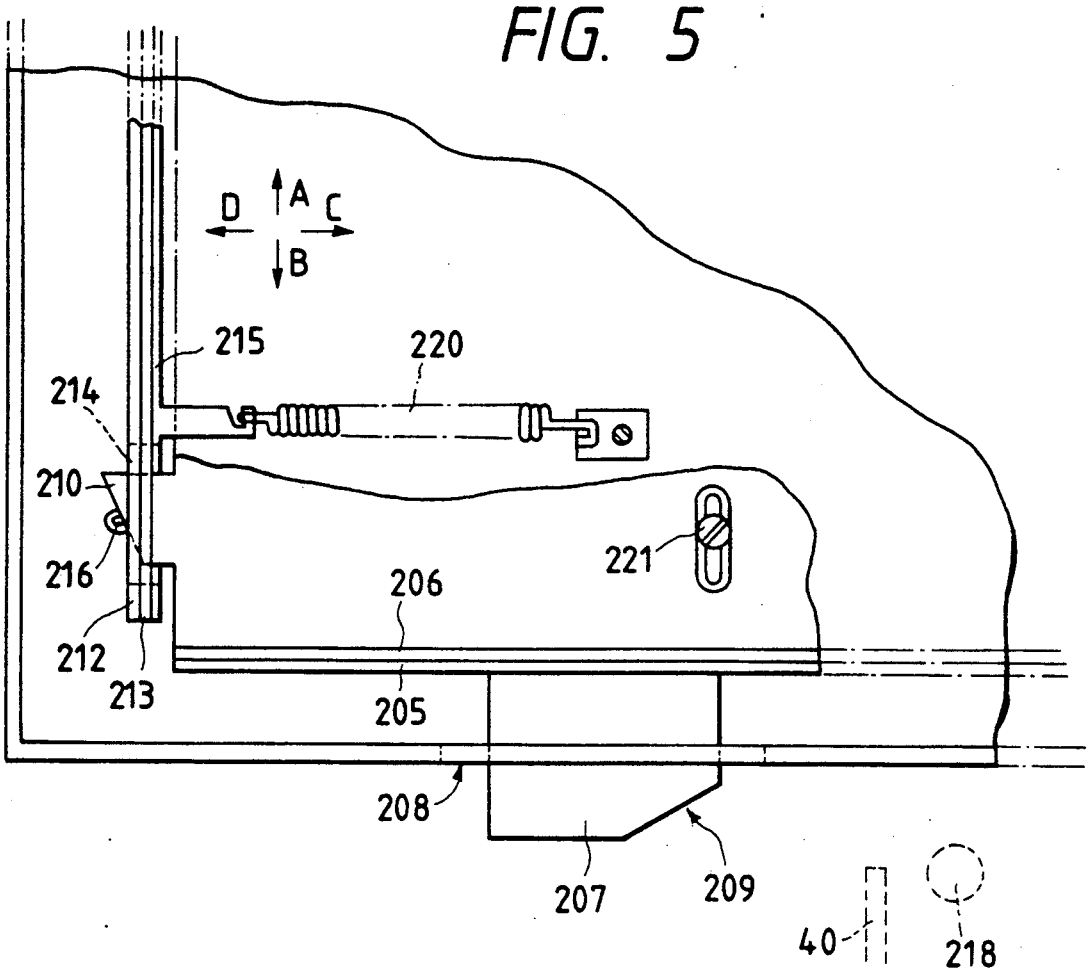
FIG. 5 is a plan view showing an interlocking mechanism provided in the sheet storage cases shown in FIGS. 4A and 4B.

The developer sheet cassette 32 will be described with reference to FIGS. 4A and 5.

The developer sheet cassette 32 has an outer frame 201 which has four walls. The cassette 32 is led by the first wall when assembled into the image recording apparatus. The first side wall is positioned rearwardly of the cassette and has an inner surface provided with a sheet formed of polyethylene terephthalate (PET), and further, a meshed sheet 202 formed of nylon having high friction coefficient is provided over the PET sheet. The second wall extending in a direction perpendicular to the first wall and positioned beside the first wall (positioned leftwardly when viewed from the front side of the cassette) has an inner surface provided with a sheet 203 formed of closed cell type foamed polyethylene. The developer sheet cassette 32 has a bottom portion on which provided is a sheet mounting base 204. The developer sheets 38 are mounted on the mounting base 204. The sheet mounting base 204 is slidably movable relative to the bottom portion in a direction indicated by arrows A and B. The sliding movement of the sheet mounting plate 204 is regulated by screws 221 which project upwardly from slots formed in the sheet mounting base 204. A supporting plate 205 upwardly extends from one side (right side in FIG.4A when viewed from the front side of the cassette) of the sheet mounting base 204 at a position beside the first wall (rightwardly relative to the meshed member 202) and in parallel with the second and third walls of the outer frame 201. The supporting plate 205 has an inner surface provided with a sheet 206 formed of closed cell type foamed polyethylene. Further, a knob piece 207 extends from an outer surface of the supporting plate 205. The third wall of the outer frame 201 is formed with a slot 208 through which the knob 207 extends. The support plate 205 and the sheet mounting base 204 are movable in the directions A and B by manually pushing the knob 207. The knob 207 has a cut away portion 209 cut by 60 degrees at a leading side thereof with respect to the cassette inserting direction. Further, the sheet mounting base 204 has the second side (left side in FIG. 4A) extending in a direction perpendicular to the first side, and cam pieces 210 and 211 extend from the second side of the sheet mounting base 204.

Another sheet supporting plate 212 is provided at a position adjacent the second side of the sheet mounting base 204. The sheet supporting plate 212 is movable in directions indicated by arrows C and D in FIG. 4A. The sheet supporting plate 212 extends in parallel with a fourth wall of the outer frame 201 and has an inner surface provided with a sheet 213 formed of closed cell type foamed polyethylene. The supporting plate 212 is formed with holes 214 and 215 through which the above described cam pieces 210 and 211 extend. Cam followers 216 and 217 vertically extend from a base portion of the supporting plate 212. The cam followers 216 and 217 are engageable with the cams pieces 210 and 211, respectively. As shown in FIG. 5, a coil spring 220 is provided at a position below the sheet mounting base 204 for normally urging the sheet supporting plate 212 in a direction of C. Therefore, the cam followers 216 and 217 are always in abutments with the cam faces of the cam pieces, to thereby define a position of the second sheet supporting plate 212. That is, upon manipulation of the knob 207 for moving the sheet mounting base 204 and the first sheet supporting plate 205 in the direction of A, the second supporting plate 212 is moved in the direction of C. Further, in case of the movements of the sheet mounting base 204 and the first sheet supporting plate 205 in the direction of B, the second supporting plate 212 is moved in the direction of D.

An area given by the closed cell type foamed resin sheets 203, 206, 213 and the meshed member 202 and defined by the depressing state of the knob 207 is coincident with the size of the sheet to be received.

In the developer sheet cassette 32 thus constructed, the stack of the developer sheets 38 are mounted on the sheet mounting base 204 with the developer-material, coated surfaces facing down while pulling out the knob 207. In this state, since the first and the second sheet supporting plates 205 and 212 are positioned outwardly, wide open area facilitates the sheet positioning on the sheet mounting base 204.

Then, the knob 207 is depressed toward the second wall, and the developer sheet cassette 32 is inserted into the copying machine. When the knob 207 is depressed, the first and the second sheet supporting plates 205 and 212 are moved inwardly, so that the developer sheets 38 are aligned with one another. At the same time, the cut edges (four side edges) of the developer sheets 38 are brought into contacts with the closed cell type foamed polyethylene sheets 203, 206, 213 and the meshed member 202. The closed cell type foamed polyethylene has high elasticity and can provide intimate contact with the edges of the sheets with low ventilation efficiency. Further, the meshed member 202 and PET sheet have the similar characteristics to those of the foamed sheets. Therefore, ambient moisture cannot be entered into the developer sheets through the cut edges, to thereby protect the quality thereof.

Further, even if an operator inadvertently inserts the developer sheet cassette into the copying machine without depressing the knob 207, the cut away portion 209 of the knob will brought into abutment with a cam follower 218 (FIG. 5) provided in the copying machine, so that the knob 207 is automatically depressed during the cassette inserting work along the cut away portion.

Figure 6:
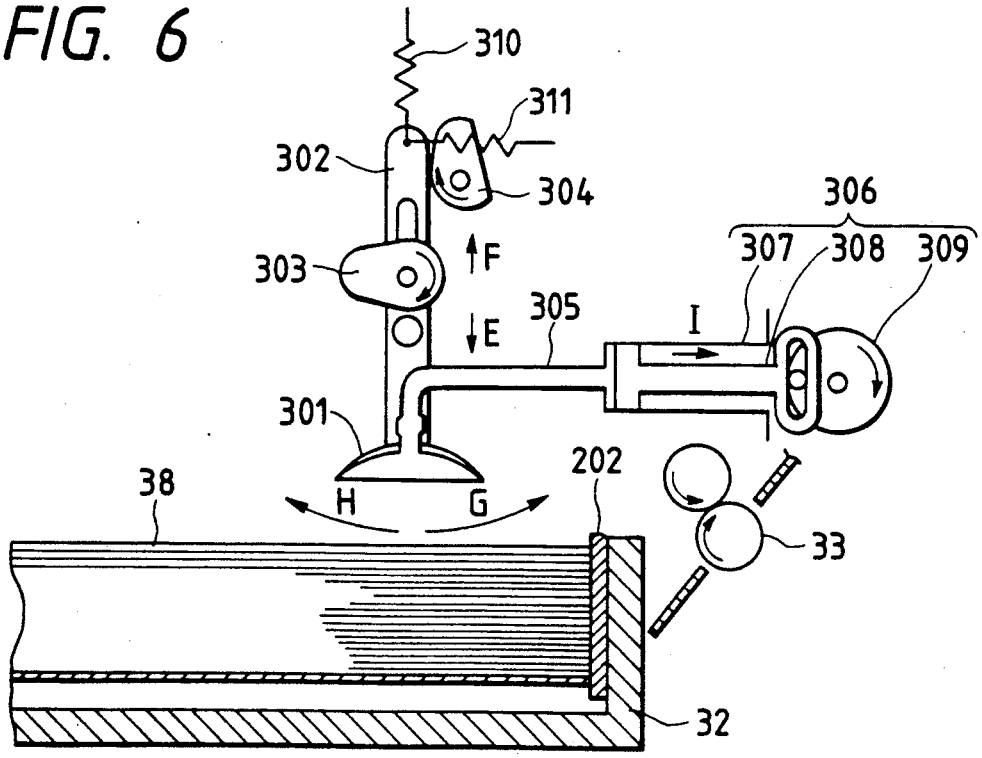
FIG. 6 is a vertical cross-sectional view showing a mechanism for feeding an uppermost sheet stacked in the sheet storage case.

Next, a sheet feeding device provided with a suction cup 301 for feeding the developer sheet 38 will be described with reference to FIG. 6. The suction cup 301 is attached to a lower end portion of an arm 302 suspended through a spring 310. Further, a first cam 303 is rotatably provided to move the arm 302 in a direction indicated by an arrow E against the biasing force of the spring 310 and in a direction indicated by an arrow F. Further, a second spring 311 is connected to the arm 302 and a second cam 304 is rotatably provided to pivotally move the arm 302 in a direction indicated by an arrow G against the biasing force of the spring 311 and in a direction H. The suction cup 301 has an inner space connected to a pressure reducing means 306 through a tubular member 305. The pressure reducing means 306 includes a cylinder 307, a piston 308 and a crank mechanism 309. Upon rotation of the crank 309, the piston 308 is reciprocally moved in a direction indicated by an arrow I. The first and second cams 303, 304 and the crank 309 are mechanically linked with each other so as to perform their operations at proper timings.

Figure 7A:
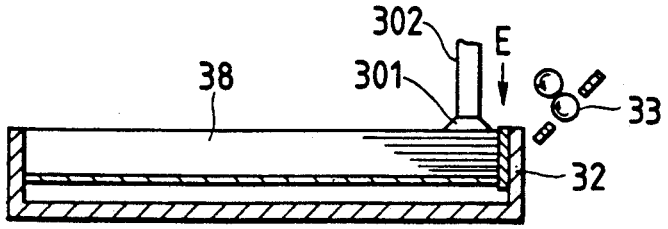
FIGS. 7A through 7E are vertical cross-sectional views for illustrating feeding sequences of a sheet feeding operation.
Figure 7B:
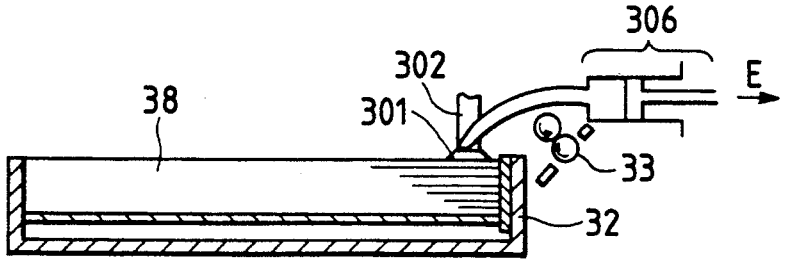
Figure 7C:
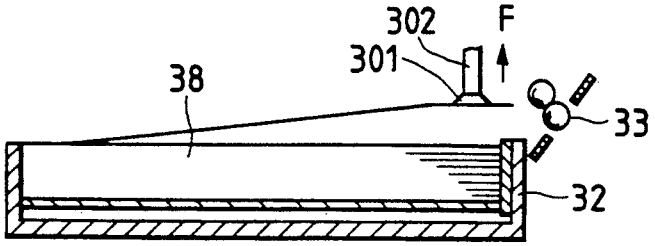

Operations of the sheet feeding device will be described with reference to FIGS. 6 and 7A through 7E. Firstly, by the rotation of the cam 303, the arm 302 is moved in the direction E, so that the suction cup 301 is brought into contact with the uppermost sheet 38 in the cassette (FIG. 7A). Next, by the rotation of the crank 309, the piston 308 is moved in the direction I, so that a negative pressure is provided within the cylinder 307. Therefore, the negative pressure is applied to the uppermost sheet 38 for the sheet sucking (FIG. 7B). Thereafter, the arm 302 is moved in the direction F by the rotation of the cam 303 while maintaining the negative pressure between the suction cup 301 and the uppermost developer sheet 38. In this case, the uppermost developer sheet 38 will be lifted together with the disk 301 (FIG. 7C).

In this case, the next developer sheet may be urged upwardly due to the negative pressure. However, since the meshed member 202 has high friction coefficient, the upward movement of the next sheet will be restrained by the meshed member 202.

Figure 7D:
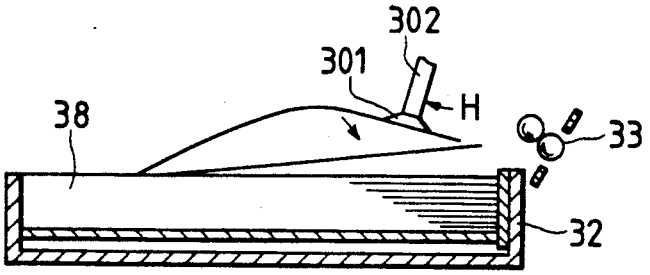
Figure 7E:
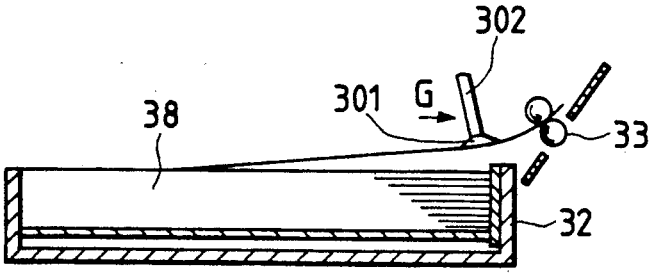

Then, the arm 302 is pivotally moved in the direction of H by the rotation of the cam 304. In this case, one side edge of the developer sheet 38 undergoes positioning by the developer sheet cassette 32, and therefore, the uppermost sheet 38 will be bent. Therefore, even if the subsequent sheet comes along with the uppermost sheet, the subsequent sheet may be separated from the uppermost sheet because of the bending. (FIG. 7D). Lastly, the arm 302 is pivotally moved in the direction of G by the rotation of the cam 304, so that the uppermost sheet 38 is solely introduced into the developer sheet feed roller 33 (FIG. 7E). In the sheet feeding device, the above described operations are consecutively carried out in response to the sheet feed signal sent from the copying machine 40.

The embodiment described above pertains to the copying machine in which latent image is formed on the microcapsule sheet by a light reflected from the original. However, it would be apparent that the present invention is also available for other type of image recording apparatus which uses another kinds of photosensitive pressure sensitive recording sheet.

As described above, each of the sheets can be taken out without any damage thereto. Therefore, the developer material can be protected against scraping-off from the developer sheet surface. In addition, the sheets can be easily stored into the case, and the sheets can be subjected to easy positioning.

Figure 4B:
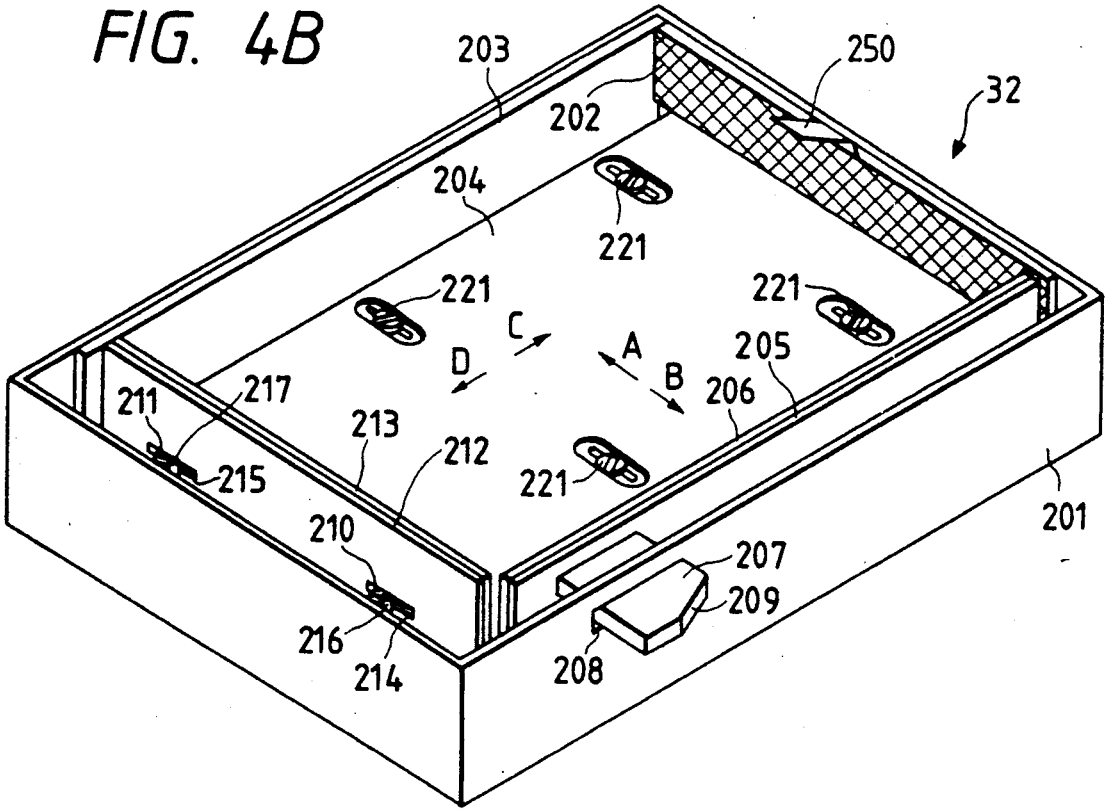

A modified sheet storage cassette will be described with reference to FIG. 4B. FIG. 4B is similar to FIG. 4A but different therefrom in that a leaf spring 250 is attached at the upper portion of the first side wall. The leaf spring 250 is bent inwardly. The leaf spring 250 functions as an abutting member, and is oriented at an angle of 45 degrees with respect to the first wall.

Figure 8A:
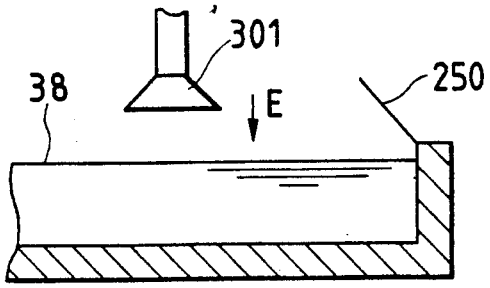
FIGS. 8A through 8D are vertical cross-sectional views for illustrating feeding sequences of a sheet feeding operation.
Figure 8B:
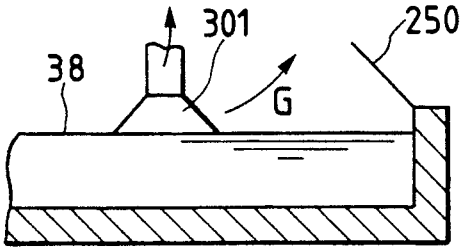
Figure 8C:
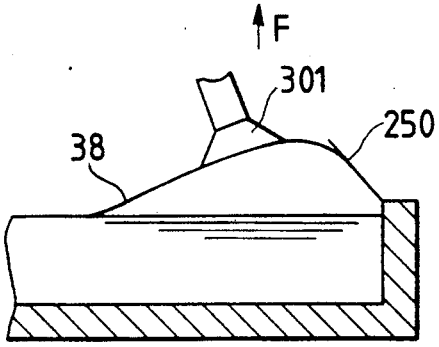
Figure 8D:
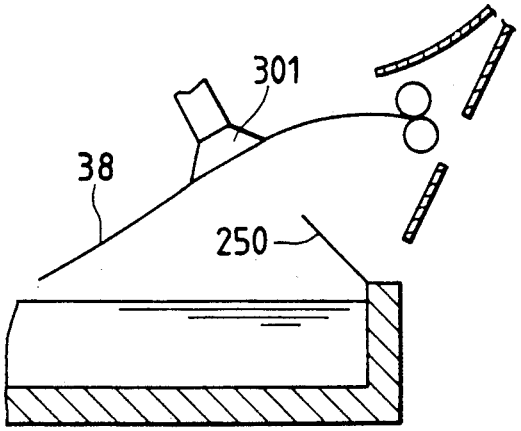

Operations of the sheet feeding device will be described with reference to FIGS. 4B and 8A through 8D. Firstly, by the rotation of the cam 303, the arm 302 is moved in the direction E, so that the suction cup 301 is brought into contact with the uppermost sheet 38 of the stack of sheets in the cassette (FIG. 8A). Next, by the rotation of the crank 309, the piston 308 is moved in the direction I, so that a negative pressure is provided within the cylinder 307. Therefore, the negative pressure is applied to the uppermost sheet 38 for the sheet sucking (FIG.8B). Thereafter, the arm 302 is moved in the direction of G by the rotation of the cam 304 while maintaining the negative pressure between the suction cup 301 and the uppermost developer sheet 38. In this case, the right side edge of the uppermost developer sheet 38 is in abutment with the leaf spring 250, so that the uppermost sheet is bent. Therefore, even if the subsequent sheet is accidentally lifted, the sheet will be separated from the uppermost sheet with providing a space therebetween. (FIG. 8C). Lastly, the arm 302 is pivotally moved in the direction of F by the rotation of the cam 303, so that the uppermost sheet 38 is solely introduced into the developer sheet feed roller (FIG. 8D). In the sheet feeding device, the above described operations are consecutively carried out in response to the sheet feed signal sent from the copying machine 40.

This modified sheet storage case is particularly useful in the case where developer sheets having a resin base are stacked therein, which are used in an overhead projector, such sheets being greatly influenced by the static electricity in comparison with plane papers. The developer sheet for use in the overhead projector has a rigidity higher than that of the plane paper. Therefore, the abutting means such as the leaf spring can provide its intended function in case of the sheet having resin base. Further, the resin base developer sheet does not provide high moisture content ratio. Therefore, the closed cell type foamed polyethylene sheet can be dispensed with.

Figure 9A:
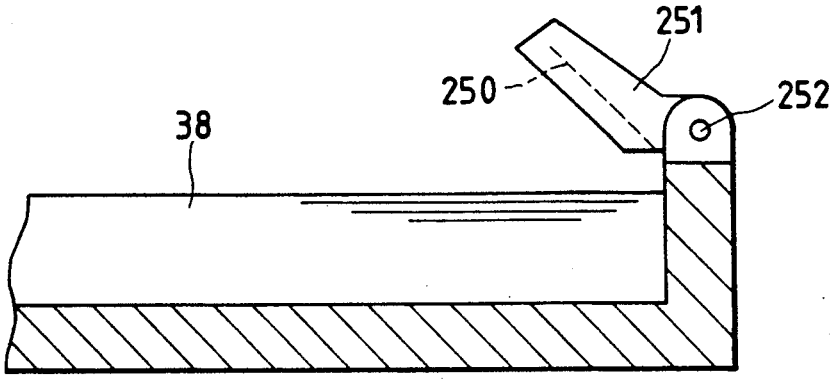
FIGS. 9A and 9B are vertical cross-sectional view for illustrating feeding operation.
Figure 9B:
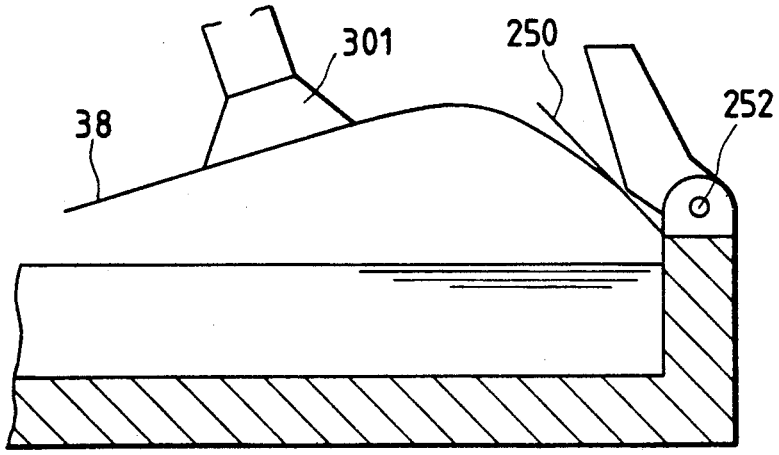

Further, as shown in FIG. 9A a cover member 251 may be provided so as to avoid any danger caused by operator's accidental touching with the leaf spring. The cover 251 is rotatable about a shaft 252. When the developer sheet 38 abuts the cover 251, the cover 251 is lifted as shown in FIG. 9B, so that the developer sheet 38 can be brought into abutment with the leaf spring 250.

A sheet storage case according to another embodiment of this invention will be described with reference to FIG. 10.

Figure 10:
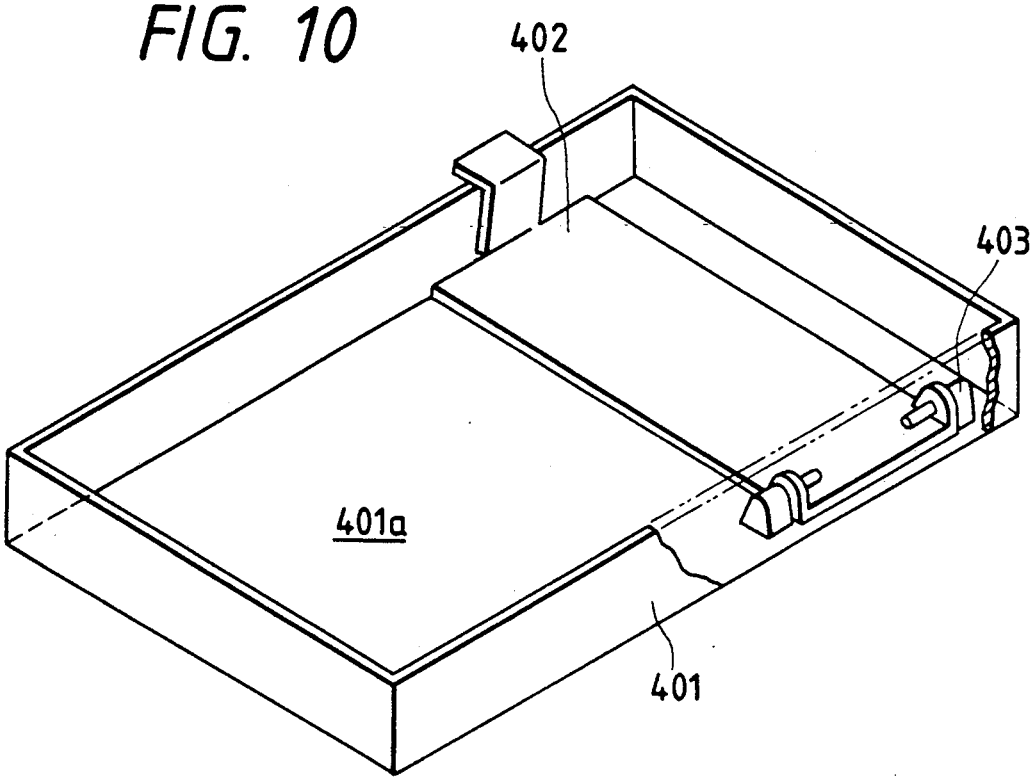
FIGS. 10 and 11 are perspective views showing a sheet storage case according to still another embodiment of the present invention.

As shown in FIG. 10, a sheet storage case 401 container has a bottom plate 401*a*On the bottom plate 401*a*, a movable member 402 is provided rotatable about a pivot portion 403. Sheets can be mounted on the bottom plate 401*a* and the movable member 402.

Figure 11:
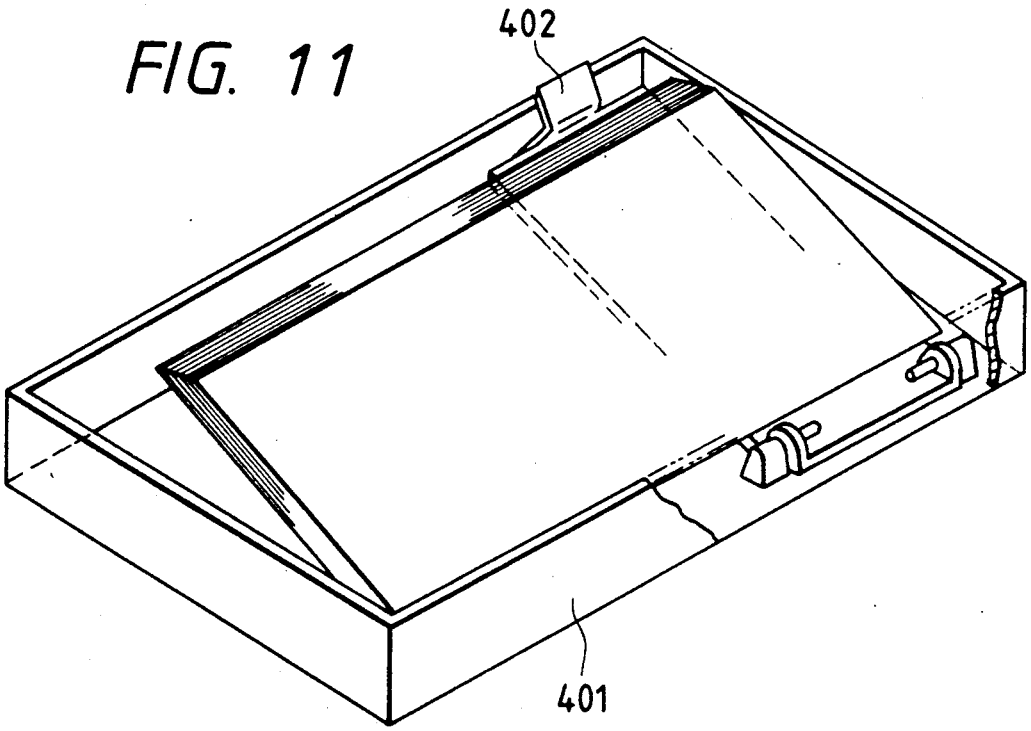

Next, operation will be described with reference to FIGS. 10 and 11. In an ordinary sheet mounting state, the movable member 402 is provided flush with the bottom plate 401*a*. In case of the removal of the sheets from the storage case 401, the movable member 402 is rotated about the pivot portion 403 so as to lift the movable member 402 upwardly. Therefore, the sheets mounted are also lifted together with the movable member 402. An operator can easily remove the stored sheets from the storage case.

According to the sheet storage case of this embodiment, sheets stored in the case can be easily removed by simply providing the movable member.

Referring to FIGS. 12 and 13A through 13C, a sheet storage case according to further embodiment of the invention will be described.

Figure 12:
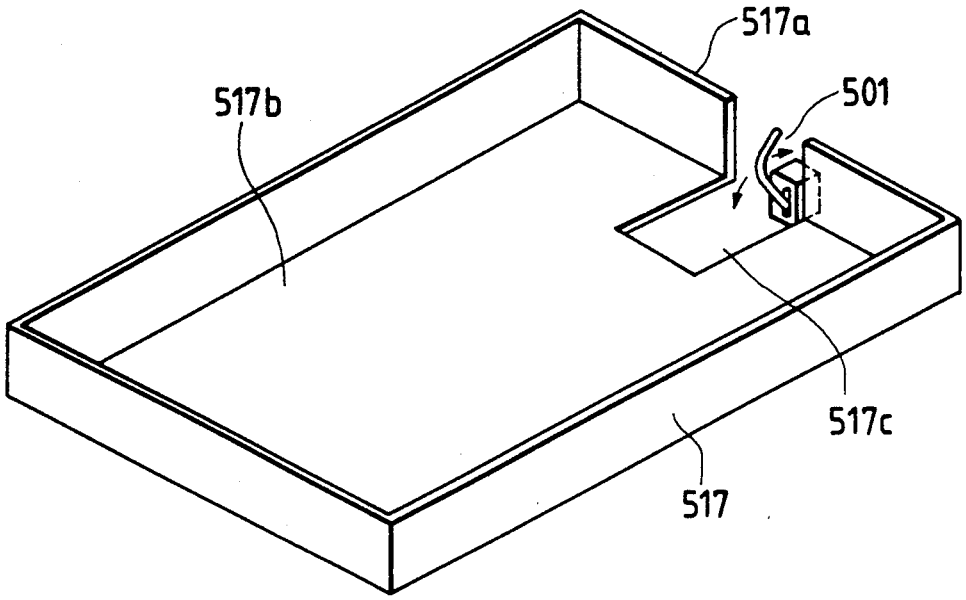
FIG. 12 is a perspective view showing a sheet storage case and a sensor according to still further embodiment of the present invention.

As shown in FIG. 12, a sensor 501 is provided in association with the sheet storage case 517. Specifically, the sensor 501 is disposed at a position corresponding to a case inserting position in the image recording apparatus. The sensor 501 is for detecting both the assembly of the sheet storage case 517 and existence of a stack of the sheets 38 within the case 517.

Figure 13A:
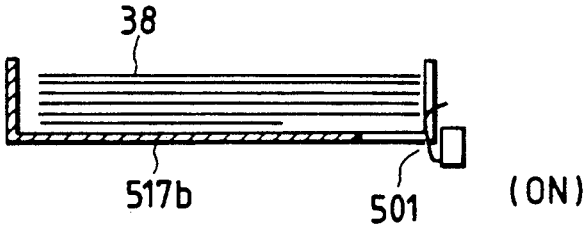
FIGS. 13A through 13C are vertical cross-sectional views illustrating the operation of the sensor shown in FIG. 12.
Figure 13B:
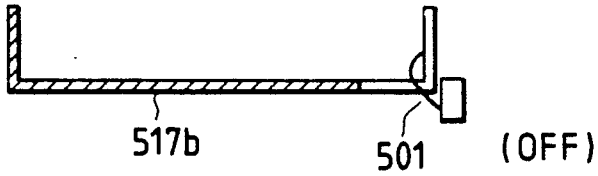
Figure 13C:
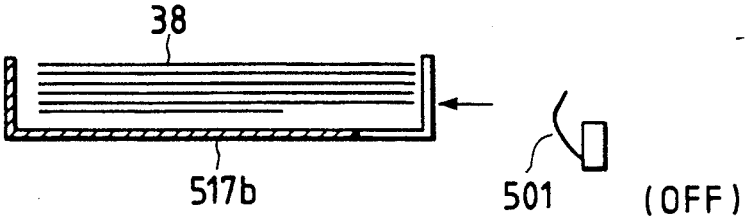

The sheet storage case 517 has a front wall 517*a* and a bottom wall 517*b* both being formed with a cut away portion 517*c* at the cassette inserting direction with respect to the image recording apparatus. The sensor 501 is arranged to detect the developer sheet 38 within the case 517. That is, if the case 517 is inserted into the image recording apparatus while storing the developer sheets 38 within the case, the sensor 501 is rendered ON shown in FIG. 13A. Therefore, the sheet storage case 517 as well as the sheet 38 are detected by the sensor 501. Starting from this state, if the developer sheet 38 are all discharged out of the storage case, the sensor 501 is rendered OFF as shown in FIG. 13B, so that detected is the state in which no sheet is stored in the case. Further, even if the stack of the developer sheets 38 are provided within the case 517, the sensor 501 is rendered OFF as shown in FIG. 13C, so that detected is the state in which no sheet storage case 517 is assembled into the image recording apparatus. Thus, the single sensor 501 serves to detect the case installation into the image recording apparatus as well as to detect the existence of the developer sheets within the case.

Incidentally, in the above described embodiment, a contact type sensor is used as the sensor 501. However, non-contact type detector such as a photo coupler or photodetection means including light emitting and light receiving elements is also available.

In this embodiment, assembly of the sheet storage case as well as the existence of the sheets within the storage case can be detected by a single sensor. Therefore, with a simple construction in comparison with the conventional device in which two sensors are required, various components can be easily arranged and assembling works can be simplified.

While the present invention has been described with respect to specific embodiments, it would be apparent to those skilled in the art that a variety of changes and modifications may be made without departing from the scope and spirit of the invention.

What is claimed is:

1. A sheet storage case for storing therein a stack of sheets, the sheet storage case being adapted to be assembled into a sheet feeding device which feeds out an uppermost sheet of the stack of sheets, the stack of sheets having first, second, third and fourth edges, the sheet storage case comprising:

a bottom plate being configured in a substantially rectangular shape and having first, second, third and fourth edges, the first and second edges extending in a direction along which the uppermost sheet of the stack of sheets is fed out by the sheet feeding device when the sheet storage case is assembled into the sheet feeding device;

a first positioning member fixedly secured to said bottom plate for positioning the first edge of the stack of sheets, said first positioning member having a sheet positioning face oriented in a first direction substantially parallel to the first edge of said bottom plate and substantially orthogonal to said bottom plate;

a second positioning member provided on said bottom plate to be slidably movable in a second direction perpendicular to the first direction for positioning the second edge of the stack of sheets, said second positioning member having a sheet receiving portion for receiving the stack of sheets and a sheet positioning face for positioning the second edge of the stack of sheets;

guide means for guiding the sliding movement of said second positioning member;

a third positioning member fixedly secured to said bottom plate for positioning the third edge of the stack of sheets;

a fourth positioning member provided on said bottom plate to be slidably movable in the first direction, wherein said second and fourth positioning members are movable in interlocking relation with each other;

an urging member for applying an urging force to said fourth positioning member in the first direction;

a cam provided on said second positioning member, said cam having a cam surface; and a cam follower provided on said fourth positioning member, said cam follower being in engagement with the cam surface of said cam due to the urging force, said fourth positioning member being moved in accordance with a movement of said second positioning member.

2. A sheet storage case according to claim 1, further comprising an attachment secured to said second positioning member, said attachment having a tapered surface, said tapered surface being brought to abutment with an abutment piece provided in the sheet feeding device when the sheet storage case is assembled into the sheet feeding device, said second positioning member being moved in the second direction when the sheet feeding device is assembled thereinto.

3. A sheet storage case according to claim 1, wherein at least one of said first, second, third and fourth positioning members has a sheet contacting portion formed with a frictional material.

4. A sheet storage case according to claim 3, further comprising urging means for urging the stack of sheets toward the member having the sheet contacting portion.

5. A sheet storage case according to claim 4, wherein said frictional material is made of nylon.

6. A sheet storage case according to claim 1, wherein said first, second and fourth positioning members are provided with sheets formed or closed cell type foamed polyethylene, and said third positioning member is provided with a sheet formed of polyethylene terephthalate and a meshed sheet formed of nylon over said polyethylene terephthalate sheet.

7. A sheet storage case according to claim 1, wherein said sheet feeding device comprises a mechanism for suspending the uppermost sheet of the stack of sheets in a third direction substantially perpendicular to said bottom plate.

8. A sheet storage case according to claim 7, wherein said mechanism comprises:

an arm extending in the third direction and having first and second ends;

means coupled to the first end of said arm for moving said arm toward and away from the stack of sheets and for swinging said arm in a position above the stack of sheets; and a suction member coupled to the second end of said arm, said suction member capable of being brought in contact with the uppermost sheet to attract the latter, said suction member to which the uppermost sheet is attracted capable of being swingably moved in a position above the stack of sheets to separate the uppermost sheet from the remaining sheets.

9. A sheet storage case according to claim 7 wherein said mechanism comprises:

an arm extending in the third direction and having first and second ends;

first urging means coupled to the first end of said arm for applying a first urging force to said arm so that said arm is normally urged in a direction away from the stack of sheets;

a suction member coupled to the second end of said arm, said suction member capable of being brought in contact with the uppermost sheet to attract the latter;

first moving means for moving said arm in a direction opposite to the first urging force so that said suction member is brought in contact with the uppermost sheet stacked in the sheet storage case;

negative pressure applying means for applying a negative pressure to said suction member so that when said suction member is brought in contact with the uppermost sheet, the uppermost sheet is attached to said suction member;

second urging means coupled to the first end of said arm for applying a second urging force to said arm so that said arm is urged in the first direction; and second moving means for moving said arm against the second urging force.

10. A sheet storage case according to claim 8, further comprising an abutment member provided on said third positioning member, the uppermost sheet being brought in abutment with said abutment member when the uppermost sheet is attracted by said suction member and swingably moved by said moving and swinging means.

11. A sheet storage case according to claim 1, wherein said sheet feeding device includes a sensor for sensing both the assembling of the sheet storage case into the sheet feeding device and the presence of the stack of sheets in the sheet storage case.

12. A sheet feeding device for feeding out sheet stacked in a sheet storage case, the stack of sheets having first, second, third and fourth edges, the sheet storage case comprising a bottom plate being configured in a substantially rectangular shape and having first, second, third and fourth edges, the first and second edges extending in a direction along which the uppermost sheet of the stack of sheets is fed out, a first positioning member fixedly secured to the bottom plate for positioning the first edge of the stack of sheets, the first positioning member having a sheet positioning face oriented in a first direction substantially parallel to the first edge of the bottom plate and substantially orthogonal to the bottom plate, a second positioning member provided on the bottom plate to be slidably movable in a second direction perpendicular to the first direction for positioning the second edge of the stack of sheets, the second positioning member having a sheet receiving portion for receiving the stack of sheets and a sheet positioning face for positioning the second edge of the stack of sheets, a third positioning member fixedly secured to the bottom plate for positioning the third edge of the stack of sheets, and a fourth positioning member provided on the bottom plate to be slidably movable in the first direction, the sheet feeding device comprising a mechanism for suspending the uppermost sheet of the stack of sheets in a third direction substantially perpendicular to said bottom plate, said mechanism comprising:

an arm extending in the third direction and having first and second ends; first urging means coupled to the first end of said arm for applying a first urging force to said arm so that said arm is normally urged in a direction away from the stack of sheets;

a suction member coupled to the second end of said arm, said suction member capable of being brought in contact with the uppermost sheet to attract the latter;

first moving means for moving said arm against the first urging force so that said suction member is brought in contact with the uppermost sheet stacked in the sheet storage case;

negative pressure applying means for applying negative pressure to said suction member so that when said suction member is brought in contact with the uppermost sheet, the uppermost sheet is attached to said suction member;

second urging means coupled to the first end of said arm for applying a second urging force to said arm so that said arm is urged in the first direction; and second moving means for moving said arm in a direction opposite to the second urging force.

* * * * *